US006105205A

United States Patent [19]

Takahashi et al.

[11] Patent Number: 6,105,205

[45] Date of Patent: Aug. 22, 2000

[54] POWER WORKING MACHINE

[75] Inventors: Kazunori Takahashi, Saitama; Fumihiko Aiyama, Tokyo, both of Japan

[73] Assignee: Kioritz Corporation, Tokyo, Japan

[21] Appl. No.: 09/243,080

[22] Filed: Feb. 2, 1999

[30] Foreign Application Priority Data

Feb. 4, 1998 [JP] Japan ..... 10-023423

[51] Int. Cl.[7] ..... A47L 5/14

[52] U.S. Cl. ..... 15/339; 15/326; 15/405

[58] Field of Search ..... 15/339, 326, 405

[56] References Cited

U.S. PATENT DOCUMENTS 3,587,515 6/1971 Anderson ..... 15/339 X
4,615,069 10/1986 Henning ..... 15/326
4,694,528 9/1987 Comer et al. ..... 15/405 X
4,884,314 12/1989 Miner et al. ..... 15/405 X
5,035,586 7/1991 Sadler et al. ..... 15/405 X
5,195,208 3/1993 Yamami et al. ..... 15/326

*Primary Examiner*—Chris K. Moore
*Attorney, Agent, or Firm*—Baker & Botts, L.L.P.

[57] ABSTRACT

A power working machine has a noise level display device which enables the noise level of the machine to be easily recognized with the naked eyes. When compressed air that is pressurized and delivered by a blower fan is delivered to an air-ejecting pipe, a noise level proportional to the magnitude of the force of the ejected air flow is indicated by the noise level display device, which is mounted on the air-ejecting pipe.

15 Claims, 6 Drawing Sheets

POWER WORKING MACHINE

BACKGROUND OF THE INVENTION

The present invention relates to a power working machine, such as a power blower of the type that is used in cleaning operations and delivers a high speed air jet from a blower, and in particular to a power working machine that has a device that detects and visually displays to a user the level of the noise produced by the machine when it is in use.

A power working machine of the above-mentioned kind, such as a power blower, is generally composed of an internal combustion engine, such as a small air-cooled two-stroke gasoline engine, that is mounted on the main body of the blower, a blower fan that is driven by the internal combustion engine, and a blower pipe that is attached to the main body. The power blower is designed to eject a high speed air jet that is generated by the rotation of the blower fan toward the ground from the distal end of the blower pipe. The high speed air jet ejected from the blower pipe is utilized for collecting scattered objects, such as fallen leaves and dust, thus performing a cleaning operation.

FIG. 7 shows one example of a conventional power blower. The power blower 10 has a main body 10*a* and a blower pipe portion 20. An internal combustion engine 11, such as a small air-cooled two-stroke gasoline engine, is mounted on one side of the main body 10*a,* and a blower fan 30 of a conventional structure (the details of which are not shown) is mounted on the other side (the side opposite to the side on which the internal combustion engine 11 is mounted) of the main body 10*a*. The blower fan 30 is coupled to the internal combustion engine 11 so as to be rotationally driven by the internal combustion engine 11.

The main body 10*a* has a cover 12, which is formed by joining two parts, i.e., a right half cover part 13 and a left half cover part 14. The right half cover part 13 is provided with a cylinder cover 13*a* for covering the cylinder of the internal combustion engine 11, the cylinder cover 13*a* being formed integrally with a side portion of the right half cover part 13. The right half cover part 13 and the left half cover part 14 are respectively and integrally provided at their upper portions with a half handle portion of a hollow handle 15, the pair of the half handle portions of the right half cover part 13 and the left half cover part 14 being combined face to face to form the hollow handle 15.

The left half cover part 14 is designed to cover the blower fan 30 and is provided at the center portion thereof with an air inlet port (not shown) for admitting external air and conducting it to the blower fan 30 disposed inside the left half cover part 14. An air-ejecting pipe 16 formed of a combined body of the right half cover part 13 and the left half cover part 14 is positioned at the forward portion of the main body 10*a*.

The aforementioned blower pipe portion 20 is removably attached to the air-ejecting pipe 16 of the main body 10*a*.

The blower pipe portion 20 is composed, for example, of a muffler section 21 (as described below, the muffler section 21 is constructed to muffle the noise of the air flow through the blower pipe portion 20) and a discharge section 31. The air inducted through the air inlet port of the left half cover part 14 into the left half cover part 14 is pressurized and delivered by the blower fan 30 and then conducted to the air-ejecting pipe 16.

The air flow pressurized and delivered by a blower fan 30 and introduced into the air-ejecting pipe 16 is then passed through the blower pipe portion 20 so as to be ejected from a flat discharge nozzle 32 which is formed at the distal end of the discharge section 31. The air flow thus ejected from the distal end of the discharge section 31 is utilized for gathering fallen leaves, etc., thereby to perform a cleaning operation.

Inasmuch as the conventional working machine such as a power blower of FIG. 7 is provided with the muffler section 21, it is possible to achieve in some extent an effect of reducing noise. However, it is still required to give a consideration to the noise which may affect the ambient environment where ambient noise is usually relatively low, such as a residential community, so that the operation of the power working machine is inhibited at times other than during the working day time, such as in the evening, at night or in the early morning.

In the present case, some degree of consideration regarding the noise output to the ambient environment may be achieved by lowering the rotational speed of engine on the basis of the operator's perception of the noise level of the machine. However, when a power working machine such as a power blower is operated continuously for a long time, the operator's perception of the noise of a power working machine is frequently diminished, thus reducing his or her ability to give a consideration of the noise being imposed on the ambient environment. Under the circumstances, there is a need to have a way of easily and reliably allowing an operator of a power machine to recognize the level of noise so as to make it possible to suitably restrict the noise level to an amount appropriate for the time of use or the environment of use of the machine.

BRIEF SUMMARY OF THE INVENTION

The present invention has been made to solve the aforementioned problems, and therefore an object of the present invention is to provide a power working machine which has a device that provides to the operator a visual indication of the noise level.

With a view to attaining the aforementioned object, the present invention provides, as an improvement in a power working machine having a blower fan for supplying compressed air and an air-ejecting pipe through which the compressed air is conducted, a noise level display device.

According to the present invention, more particularly, when a compressed air which is pressurized and delivered by a blower fan is passed to the air-ejecting pipe, a noise level proportional to the magnitude of force of the ejected air flow will be indicated by means of the noise level display device.

In the present case, it is possible to facilitate the assembling of the noise level display device, when the air-ejecting pipe is an assembly formed by two half pipe portions that are joined together, such as along a diametrical plane, and the noise level display device is mounted at a juncture of the pair of half pipe portions.

Further, it is possible to have a visible indicia of the noise level that is permissible or desirable at the time period or in the environment of use marked on a noise level display plate, when the noise level display device is constituted by a noise level display plate and a movable indicator plate.

It is possible in the present case to facilitate the mounting of the movable plate, when each of the half pipe portions is provided with a retaining groove for slidably retaining the movable plate by both side portions thereof. Further, the mounting of the noise level display plate is facilitated by mounting the noise level display plate on a mounting portion of the air-ejecting pipe.

Further, provision may be for making apparent to the naked eyes of a user of the improved power working machine the magnitude of a noise level in proportion to the force of the ejected air flow which is pressurized and delivered by the blower fan, when the noise level display plate is provided with indicia, such as a scale indicating the noise level.

It is possible in the present case for a user to easily recognize, with the naked eyes, the magnitude of a noise level proportional to the force of the ejected air flow which is pressurized and delivered by the blower fan, when an indicator projection is formed on the movable plate so as to allow the indicator projection to move along an opening formed in the noise level display plate and to indicate the mark.

Further, the movable plate may be caused to be shifted in proportion to the magnitude of the force of the ejected air flow, which is pressurized and delivered by the blower fan, by providing the noise level display plate with a protrusion which so adapted to catch an ejected air flow.

It is, moreover, possible in the present case to prevent the ejected air flow which is pressurized and delivered by the blower fan from being disturbed to thereby inhibit an increase in noise level, when the protuberance is semi-circular in cross-sectional shape.

It is suitable, in addition, to have the movable plate biased by means of a coil spring in a direction which is opposite to the direction of the ejected air flow, to cause the movable plate to be shifted in proportion to the magnitude of the force of the ejected air flow which is pressurized and delivered by the blower fan, and at the same time, to enable the movable plate to return to the original position by the resilient force of the coil spring when of the ejected air flow stops.

DESCRIPTION OF THE EMBODIMENTS

Figure 1:
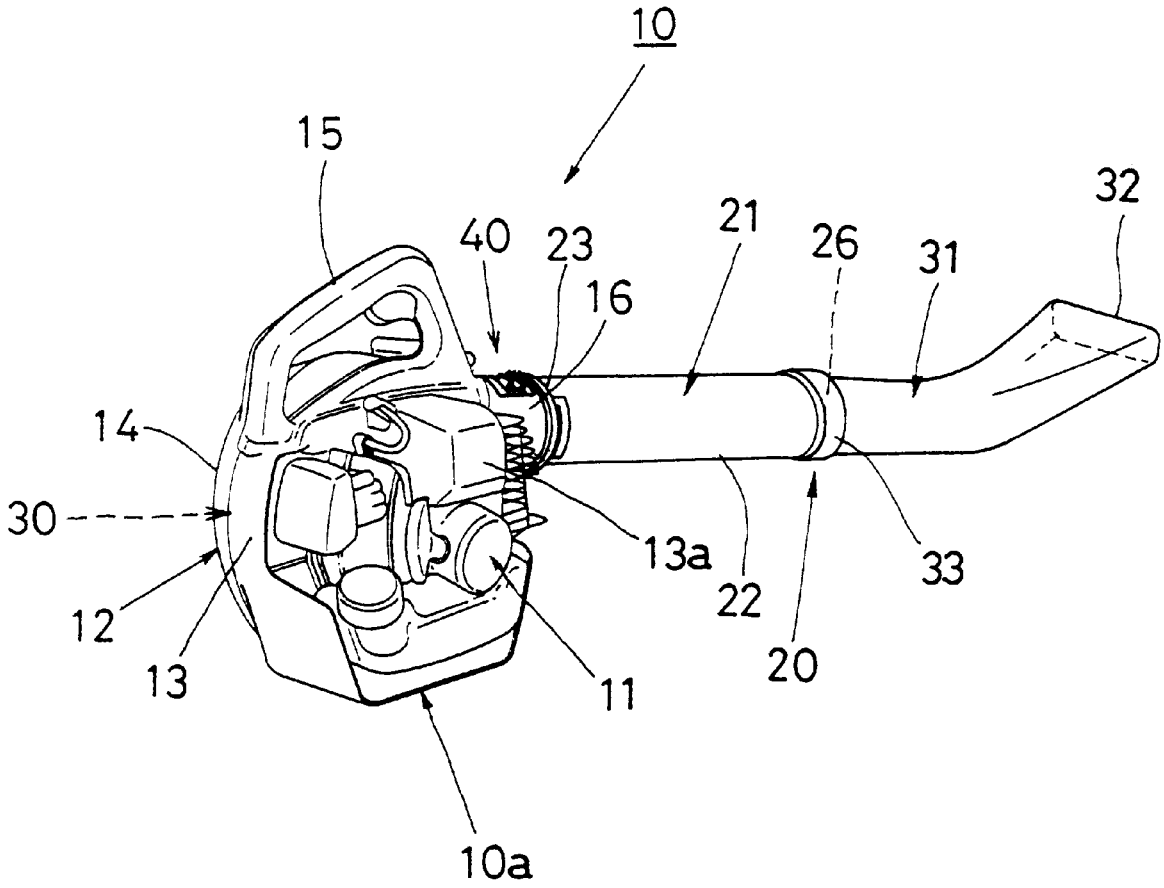
FIG. 1 is a perspective view of a power blower that exemplifies a power working machine according to one embodiment of the present invention.

One embodiment of the present invention will be explained in detail below with reference to the drawings. In FIGS. 1 to 6 and the following description, the parts which are essentially the same as those of the conventional power blower shown FIG. 7 and described above, are represented by the same reference numerals.

FIG. 1 is a perspective view of the entire structure of a power blower 10 that is exemplary of a power working machine provided with a noise level display device according to the present invention. Referring to FIG. 1, the power blower 10 is generally composed of a main body 10*a* and a blower pipe portion 20. An internal combustion engine 11, such as a small air-cooled two-stroke gasoline engine, is mounted on one side of the main body 10*a,* and a blower fan 30 is mounted on the other side (the side opposite to the side on which the internal combustion engine 11 is mounted) of the main body 10*a*. The blower fan 30 is coupled to the drive shaft (not shown) of the internal combustion engine 11 so as to be rotationally driven by the internal combustion engine 11.

The main body 10*a* has a cover 12 which is constituted by two parts that are joined together, i.e., a right half cover part 13 and a left half cover part 14. The right half cover part 13 is provided with a cylinder cover 13*a* for covering the cylinder of the internal combustion engine 11, the cylinder cover 13*a* being formed integral with a side portion of the right half cover part 13. The right half cover part 13 and the left half cover part 14 are respectively and integrally provided at their upper portions with a half handle portion of a hollow handle 15, the pair of the half handle portions of the right half cover part 13 and the left half cover part 14 being combined face to face to form the hollow handle 15.

The left half cover part 14 is designed to cover the blower fan 30, and is provided at the center portion thereof with an air inlet port (not shown) for accepting external air and conducting it to the blower fan 30 disposed inside the left half cover part 14. An air-ejecting pipe 16 formed of half sections, one section being a portion of the right half cover part 13 and the other section being a portion of the left half cover part 14, is positioned at the forward portion of the main body 10*a*. A noise level display device 40 is attached to the air-ejecting pipe 16. The air introduced from the air inlet port of the left half cover part 14 into the left half cover part 14 is pressurized and delivered by the blower fan 30 and then passed toward the air-ejecting pipe 16. The aforementioned blower pipe portion 20 is removably attached to the air-ejecting pipe 16 of the main body 10*a*. The blower pipe portion 20 is composed, for example, of a muffler section 21 and a discharge section 31.

The muffler section 21 and the discharge section 31 are detachably connected to each other. When the power blower 10 is operated, upstream end of the muffler section 21 is coupled with the air-ejecting pipe 16 of the main body 10*a,* and then the other end of the muffler section 21 is engaged with the upstream end of the discharge section 31. Accordingly, the air flow P (see FIG. 6) which has been pressurized and delivered by the blower fan 30 and introduced into the air-ejecting pipe 16 is then allowed to pass through the blower pipe portion 20 so as to be ejected from a flat discharge nozzle 32 formed at the distal end of the discharge section 31. The air flow P thus ejected from the flat discharge nozzle 32 of the discharge section 31 is utilized for gathering fallen leaves, etc., thereby to perform a cleaning operation.

FIGS. 2 to 5 illustrate the details, of one example of the noise level display device 40. The noise level display device 40 comprises a noise level display plate 41 and a movable plate 42. The noise level display plate 41 and the movable plate 42 are both designed to be mounted on the air-ejecting pipe 16 and are shaped to conform with the curved outer configuration of the air-ejecting pipe 16. The noise level display plate 41 is provided with an opening 41*a* for enabling an indicator projection 43 of the movable plate 42 to be moved therein. A mark, such as a scale 41*b* for indicating the noise level that is permissible or suitable in the environment or at the time of use, is provided along the sides of the opening 41*a*.

The movable plate 42 is configured to be mounted under the back surface of the noise level display plate 41 and is provided on the upper surface thereof with the indicator projection 43. A supporting rod 44 is attached to the downstream edge (the edge that faces away from the jet air flow P) of the movable plate 42 and receives a compression coil spring 45. A semi-cylindrical protuberance 46, which is semi-circular in cross-sectional shape and extends in a direction orthogonal to the jet air flow P, projects from the back surface of the movable plate 42. The protuberance 46 is designed and mounted so as to project a small distance into the jet air flow P (see FIG. 6) so as to have a force due to the jet air flow P imposed on it by the jet air flow P as it passes through the air-ejecting pipe 16 after being pressurized and delivered by the blower fan 30. Since the protuberance 46 is semi-circular in cross-sectional shape, the jet air flow P is prevented from forming an eddy flow in the wake of the protuberance, thereby to inhibit an increase in noise level at this zone.

As mentioned above, the air-ejecting pipe 16 is formed of semi-cylindrical half pipe portions 16*a* and 16, one portion 16*a* being a part of the right half cover part 13 and the other portion 16*b* being a part of the left half cover part 14. The pair of half pipe portions 16*a* and 16*b* are formed integrally with the halves of the cover 12, i.e. the right half cover part 13 and the left half cover part 14, respectively. Therefore, when the right half cover part 13 and the left half cover part 14 are engaged with each other upon assembly of the cover 12, the half pipe portions 16*a* and 16*b* are concurrently caused to be engaged with each other.

The half pipe portions 16*a* and 16*b* are provided adjacent the joint between them with recessed mounting portions 17*a* and 17*b*, respectively, for reception of the noise level display plate 41. The recessed mounting portions 17*a* and 17*b* are dimensioned to conform with the external dimensions of the noise level display plate 41, so that when the noise level display plate 41 is mounted on the recessed mounting portions 17*a* and 17*b*, the external surface of the noise level display plate 41 is disposed substantially flush with the external surface of the air-ejecting pipe 16.

Retaining grooves 18*a* and 18*b* for slidably retaining the right side portion 42*a* and the left side portion 42*b* of the movable plate 42, respectively, are formed below the recessed mounting portions 17*a* and 17*b*, respectively. A groove 18*c* for accommodating the compression coil spring 45 fitted over the supporting rod 44 is also formed in communication with the retaining grooves 18*a* and 18*b*. One end of the compression coil spring 45 engages the end face 18*d* of the groove 18*c*. As installed, the spring 45 is compressed so as to impose a bias upon the movable plate 42 in the direction of arrow "a" (see FIG. 6), i.e. in the direction opposite to the direction of the jet air flow P.

The half pipe portions 16*a* and 16*b* are also provided at their distal side wall portions with engaging protrusions 19*a* and 19*b*, which are configured to be engaged in engaging grooves 24 and 25 of the muffler section 21, the engaging protrusions 19*a* and 19*b* being diametrically opposite each other. The muffler section 21 comprises an outer pipe 22 and an inner pipe (not shown), which is disposed inside the outer pipe 22 with a space being maintained between the inner and outer pipes. The space is filled with urethane foam (not shown), which serves as a muffler in such a manner that the wall thickness thereof is made relatively thin so as to minimize the resistance to be generated therefrom and that the length thereof is made relatively large so as to secure a sufficient silencing volume thereof. The outer diameter of the outer pipe 22 may be selected to be such that it can be suitably grasped by an operator in the operation of the power blower 10. Although it is preferable that the outer diameter of the outer pipe 22 is substantially uniform throughout the entire length thereof, the outer pipe 22 may be slightly tapered to enhance the appearance thereof.

Figure 2:
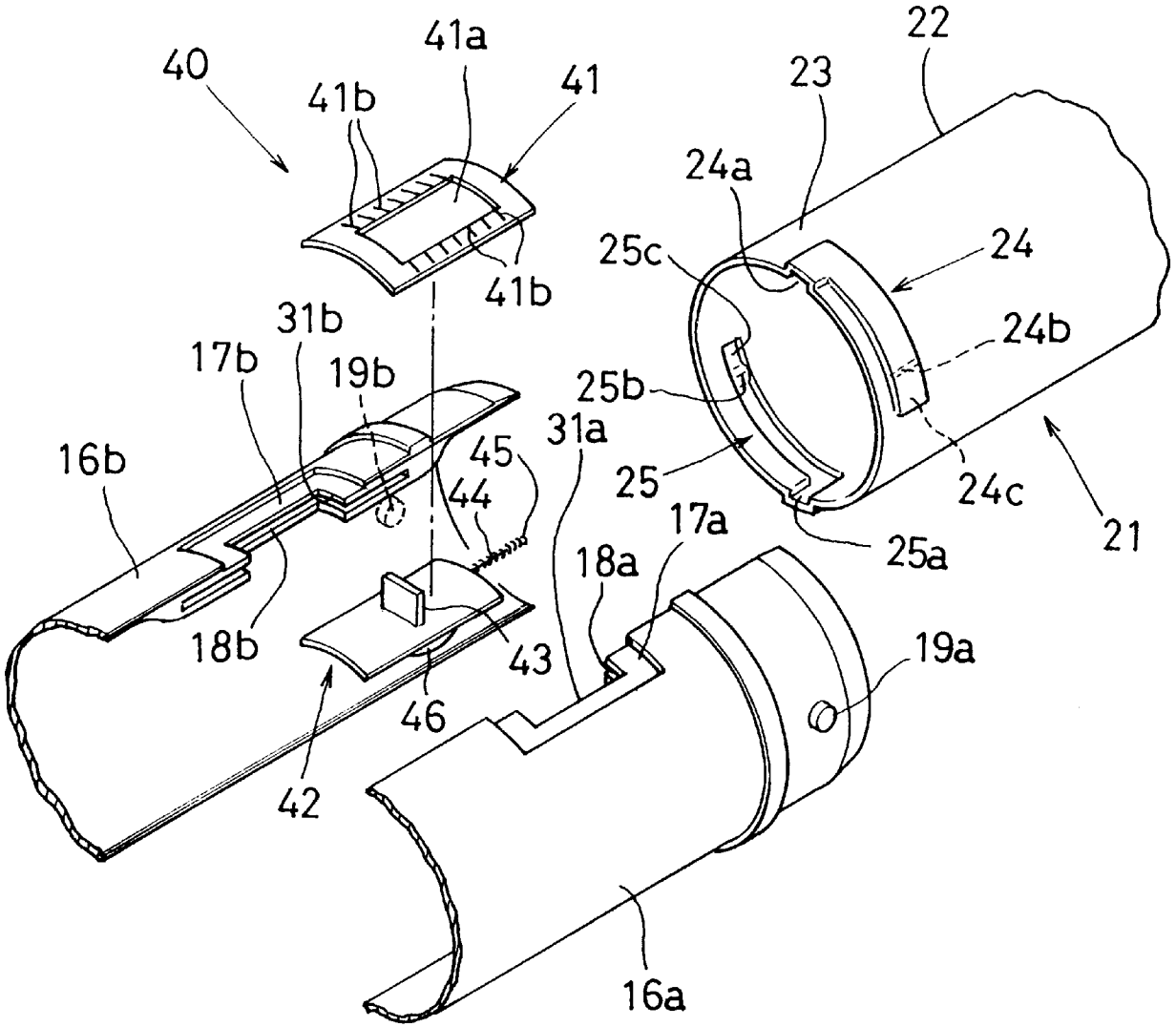
FIG. 2 is an enlarged exploded perspective view illustrating the mounting portion of a noise level display device of the machine shown in FIG. 1.
Figure 3:
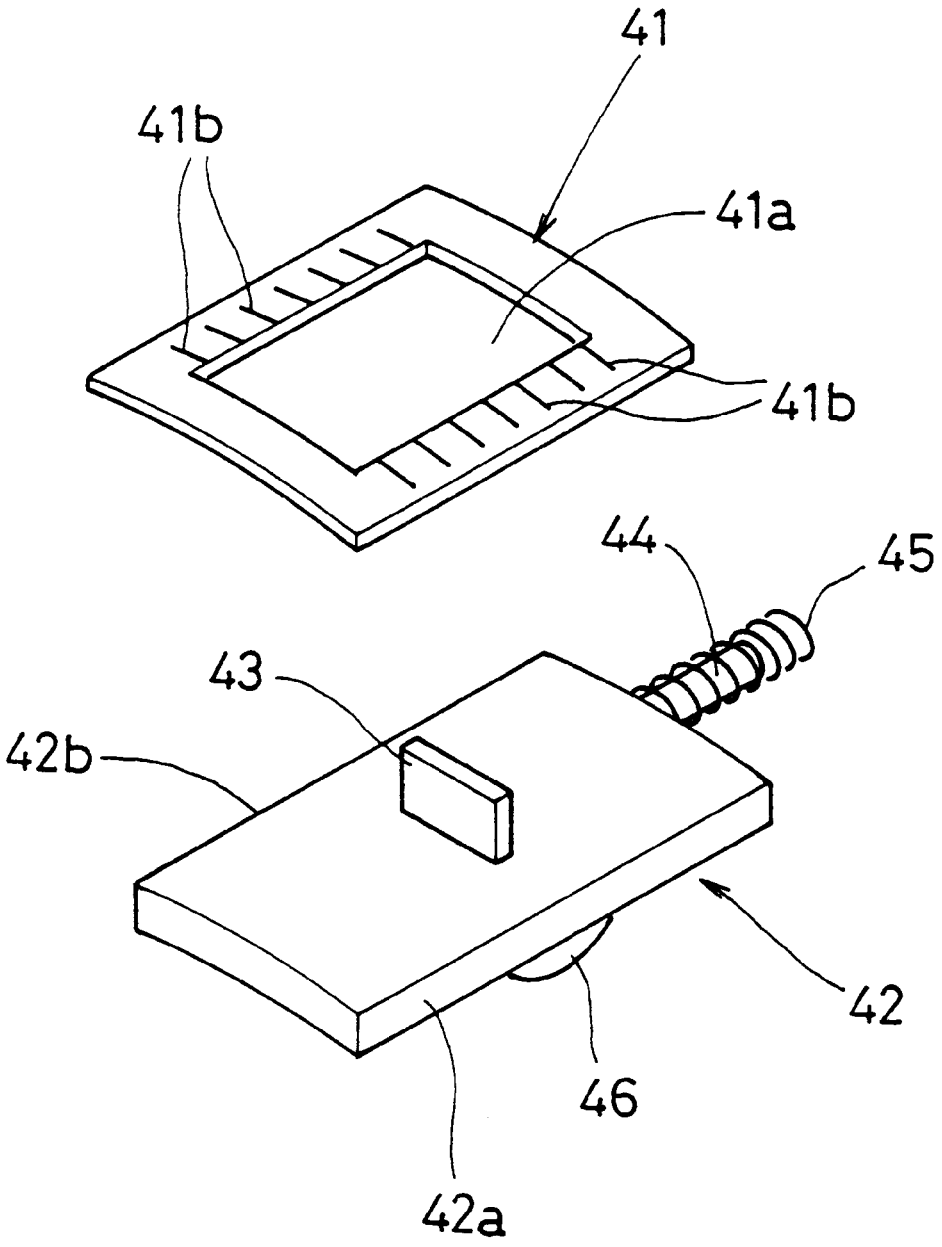
FIG. 3 is an enlarged perspective view of a portion of the noise level display device of FIG. 2.
Figure 4:
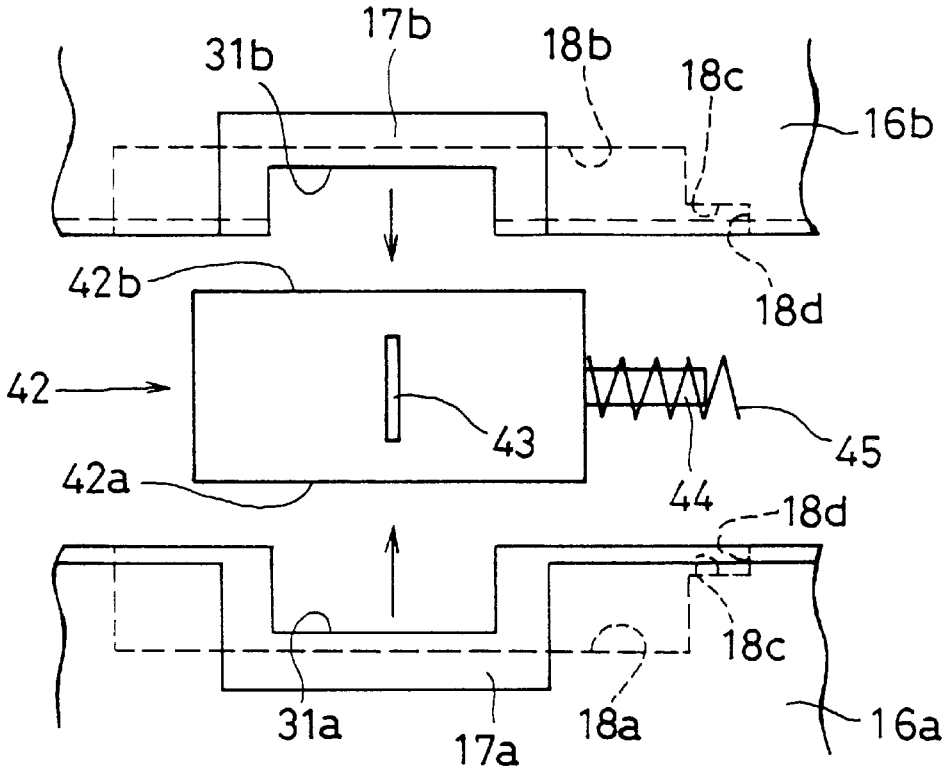
FIG. 4 is a plan view illustrating a method of mounting the noise level display device shown in FIG. 2.
Figure 5:
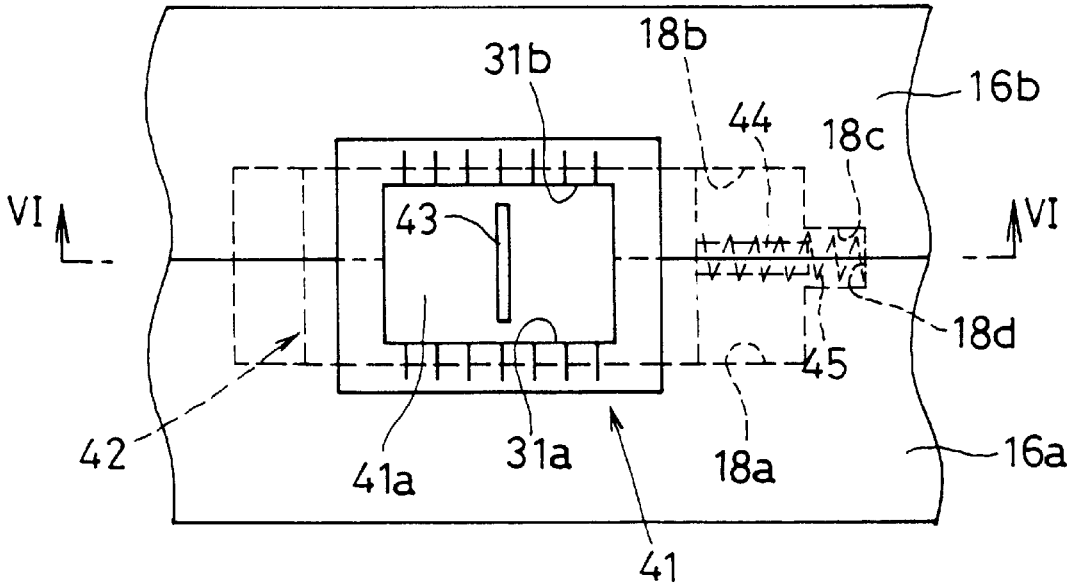
FIG. 5 is a plan view illustrating the noise level display device shown in FIG. 2 as fully assembled.

As shown in FIG. 2, the proximal end portion (the upstream side of the jet air flow P) of the outer pipe 22 is constituted by an inlet side engaging portion 23 which is adapted to be engaged with the air-ejecting pipe 16 of the main body 10*a* of the power blower 10. The distal end portion (the downstream side of the jet air flow P) of the outer pipe 22 is constituted by an outlet side engaging portion 26 (see FIG. 1), which is adapted to be engaged with an inlet side engaging portion 33 of the discharge section 31. As shown in FIG. 2, the inlet side engaging portion 23 constituting the proximal end portion of the outer pipe 22 is provided at the opposite side walls thereof with a pair of L-shaped engaging grooves 24 and 25 which are located diametrically opposite from each other. The base portions of the engaging grooves 24 and 25 protrude outwardly from the outer wall surface of the outer pipe 22.

The fore-end portions of the engaging grooves 24 and 25 are constituted by inlet portions 24*a* and 25*a*, respectively, for allowing the engaging protrusions 19*a* and 19*b* to be received. The rear-end portions of the engaging grooves 24 and 25 are provided with stopper ridges 24*b* and 25*b*, and with terminal engaging portions 24*c* and 25*c*, respectively. Thus, the engaging protrusions 19*a* and 19*b* that have been introduced from the inlet portions 24*a* and 25*a* into the engaging grooves 24 and 25 are then allowed, after passing over the stopper ridges 24*b* and 25*b*, respectively, to fit in the terminal engaging portions 24*c* and 25*c*, respectively, thereby accomplishing the coupling of the outer pipe 22 to the air-ejecting pipe 16.

Additionally, since the width of the engaging grooves 24 and 25 are gradually narrowed beginning from the fore-end portions thereof toward the rear-end portions thereof, the fitting of the engaging protrusions 19*a* and 19*b* in the engaging grooves 24 and 25 can be excellently achieved, and at the same time, rattling of the engaging protrusions 19*a* and 19*b* in the terminal engaging portions 24*c* and 25*c* can be effectively prevented.

The diameter of the inlet side engaging portion 23 is made slightly larger than that of the intermediate portion of the outer pipe 22, thereby allowing the air-ejecting pipe 16 of the main body 10*a* to be fitted in and fixed to the inlet side engaging portion 23. The outlet side engaging portion 26 (the details of which are not shown) of the outer pipe 22 is constructed to have the same external configuration as that of the air-ejecting pipe 16.

As shown in FIG. 1, the outlet side engaging portion 26 of the outer pipe 22 is designed to be coupled with the rear end portion (the upstream end with respect to the jet air flow P) 33 of the discharge section 31. Accordingly, the rear end portion 33 of the discharge section 31 is constructed to have the same configuration as that of the inlet side engaging portion 23 of the outer pipe 22. Namely, the rear end portion 33 (the details of which are not shown) of the discharge section 31 is provided at the opposite side walls thereof with a pair of L-shaped engaging grooves, each of which consists of a longitudinal portion and a circumferential portion extending orthogonally from the longitudinal portion, and the base portion thereof protruding outwardly from the outer wall surface of the discharge section 31.

The pair of L-shaped engaging grooves of the rear end portion 33 of the discharge section 31 is designed to be engaged with a pair of engaging protrusions (not shown) of the outlet side engaging portion 26 of the outer pipe 22, thereby accomplishing the coupling of the proximal end portion 33 of discharge section 31 to the distal end portion 26 of the outer pipe 22.

The inlet side of the inner pipe (not shown) that is located inside the outer pipe 22 is extended close to the inlet side engaging portion 23 of the outer pipe 22, and the end portion constituting the inlet side of the inner pipe is tapered (thickness-wise) and sector-shaped so as to allow the jet air flow P to be introduced, while minimizing any resistance against the jet air flow P from the air-ejecting pipe 16 of the main body 10*a* into the inner pipe (not shown) of the muffler section 21.

A large number of silencing holes (not shown) are formed in the peripheral wall of the linear pipe portion (not shown) extending from the tapered proximal portion of the inner pipe so as to allow part of the jet air flow P to be introduced via the silencing holes into the urethane foam (not shown) interposed between the outer pipe 22 and the inner pipe (not shown), thereby achieving the silencing of noise.

Next, the function of the aforementioned the noise level display device 40 will be explained.

Figure 6:
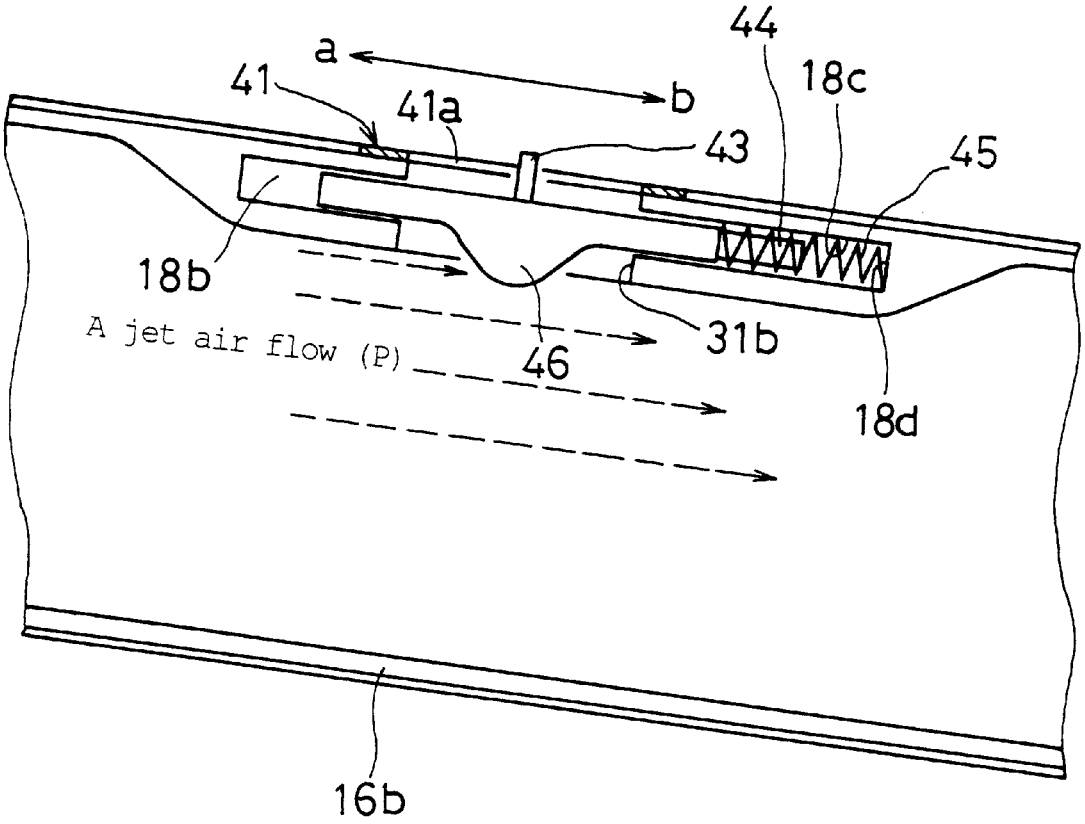
FIG. 6 is a cross-sectional view taken along the line VI—VI of FIG. 5.
Figure 7:
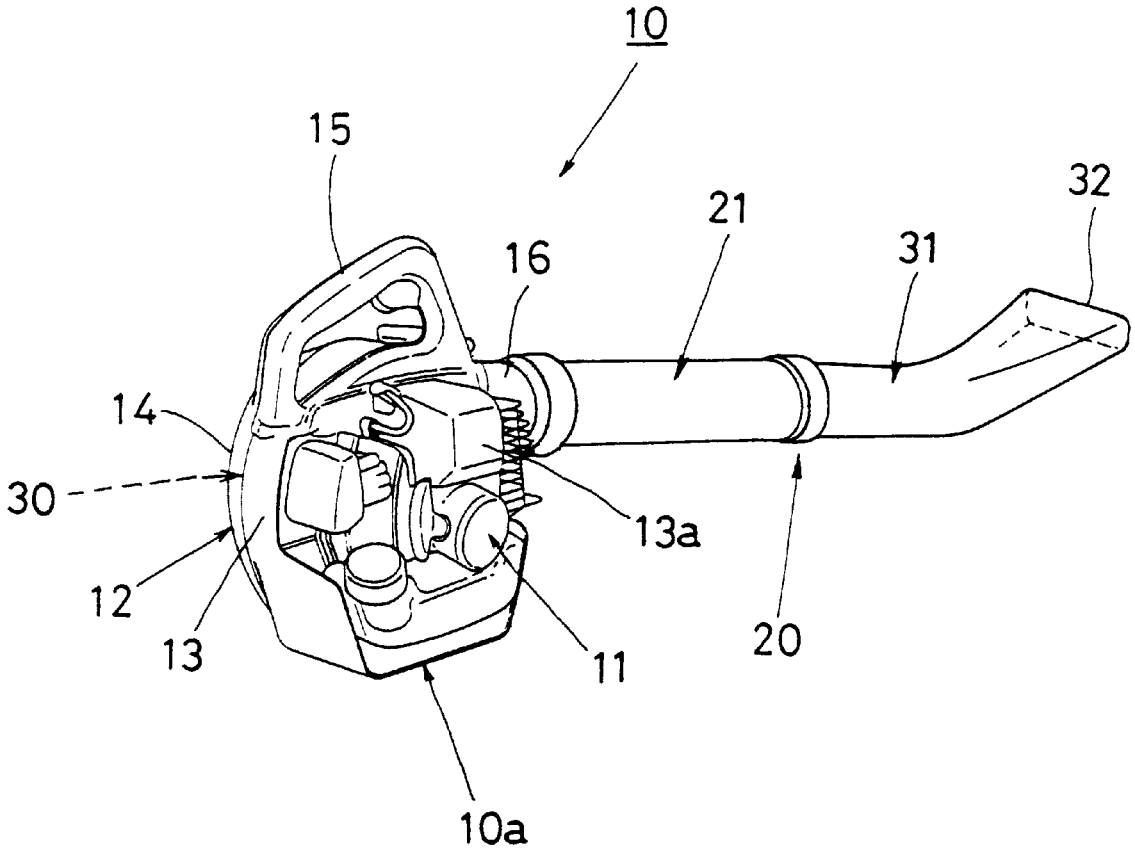
FIG. 7 is a perspective view illustrating one example of a conventional power blower.

First of all, the procedures for mounting the noise level display device 40 onto the air-ejecting pipe 16 will be explained. Since the half pipe portions 16*a* and 16*b* of the air-ejecting pipe 16 are formed integrally with the partitioned halves of the cover 12, i.e. the right half cover part 13 and the left half cover part 14, respectively, the mounting of the noise level display device 40 onto the air-ejecting pipe 16 is performed simultaneously with the engagement of the right half cover part 13 with the left half cover part 14. In particular, as shown in FIGS. 2 to 5, the right and left side portions 42*a* and 42*b* of the movable plate 42 are inserted into the retaining grooves 18*a* and 18*b* of the half pipe portions 16*a* and 16*b*, respectively, and at the same time, the half pipe portions 16*a* and 16*b* are engaged with each other. As a result, the movable plate 42 is retained in the air-ejecting pipe 16 while being allowed to move in the direction of the jet air flow P. In this case, as shown in FIG. 6, the compression coil spring 45 fitted over the supporting rod 44 which is attached to the downstream side (i.e. the downstream side of the jet air flow P) of the movable plate 42 is accommodated in the groove 18*c* formed in communication with the aforementioned retaining grooves 18*a* and 18*b* in such a manner that one end of the compression coil spring 45 engages the end face 18*d* (i.e. which is located on the downstream end of the grooves 18*b* with respect to the jet air flow P) of the groove 18*c*. As a result, the movable plate 42 is biased in the direction of the arrow "a", i.e., in the direction opposite to the direction of the jet air flow P.

After finishing the mounting of the movable plate 42 and the engagement between the half pipe portions 16*a* and 16*b*, the noise level display plate 41 is fitted in the recessed mounting portions 17*a* and 17*b* formed respectively on the half pipe portions 16*a* and 16*b*. The indicator projection 43 of the movable plate 42 protrudes from the air-ejecting pipe 16 through the openings 31*a* and 31*b* formed in the half pipe portions 16*a* and 16*b* as well as through the opening 41*a* of the noise level display plate 41. In order to prevent the noise level display plate 41 from falling off, the noise level display plate 41 may be adhered onto the recessed mounting portions 17*a* and 17*b* by means of an adhesive, for example. Alternatively, the noise level display plate 41 may be detachably hooked to the recessed mounting portions 17*a* and 17*b* by providing the noise level display plate 41 and the recessed mounting portions 17*a* and 17*b* with either hooks or hook-receiving portions.

When the internal combustion engine 11 is started to actuate the blower fan 30, air is introduced through the air inlet opening (not shown) formed in the left half cover part 14 into the left half cover part 14. The air thus introduced therein is pressurized and delivered by the blower fan 30 and then conducted to the air-ejecting pipe 16.

The jet air flow P which has been pressurized and delivered by the blower fan 30 and introduced into the air-ejecting pipe 16 then passes through the blower pipe portion 20 so as to be ejected from the flat discharge nozzle 32 at the distal end (or the downstream side of the jet air flow P) of the discharge section 31. The jet air flow P thus ejected from the distal end of the discharge section 31 is utilized for gathering fallen leaves, etc. thereby to perform a cleaning operation.

When the muffler section 21 as constructed in the manner described above, it is possible to significantly reduce the noise level in the high frequency zone. For example, it is possible, as compared with the conventional blower pipe provided with no silencing device, to reduce the noise level by about 1 dB (A) in the average of the ambient area, and by about 3 to 4 dB (A) in the direction of jet air flow.

As shown in FIG. 6, the force of the pressurized jet air flow P, which has been introduced into the air-ejecting pipe 16, acts on the semi-cylindrical protuberance 46 of the movable plate 42, thereby to cause the movable plate 42 to move in the direction indicated by the arrow "b" (toward the downstream side of the jet air flow P) against the biasing force of the compression coil spring 45. Due to the movement of the movable plate 42 in the direction of the arrow "b", the indicator projection 43 attached to the upper surface of the movable plate 42 is concurrently moved along the opening 41*a* of the noise level display plate 41 until the indicator projection 43 settles at the position where the biasing force of the compression coil spring 45 is balanced with the force of the jet air flow P. As a result, it is possible to know the noise level generated from the working of the power blower by reading the location of the indicator projection 43 in relation to the scale 41*b* marked along the sides of the display plate 41 adjacent the opening 41*a*.

Accordingly, since a sufficient consideration for the prevention of excessive noise can be taken through the recognition of the scale 41*b* with the naked eyes, so that the rotational speed of the internal combustion engine 11 can be properly adjusted to meet the level of noise permissible or suitable at the time of or in the environment of use, the cleaning operation can be performed without annoying the persons living nearby, even if the cleaning operation is performed, for example, early in the morning or in an environment or area where the employment of the power blower may be bothersome to nearby persons.

As explained above, according to the embodiment of the present invention, when the jet air flow P which is pressurized and delivered by the blower fan 30 is passed into the air-ejecting pipe 16, a noise level proportional to the magnitude of force of the jet air flow P is indicated by means of the noise level display device 40 mounted on the air-ejecting pipe 16. Therefore, it is possible, through the recognition of the scale 41*b*, to readily adjust the rotational speed of the internal combustion engine 11 so as to meet the level of noise permissible or acceptable at the time or in the environment of use of the machine, thereby making it possible to perform the cleaning operation without annoying the persons living nearby.

Further, since the air-ejecting pipe 16 is composed of a jointed body partitioned into a pair of half pipe portions 16*a* and 16*b,* and the noise level display device 40 is mounted at a joint portion of the pair of half pipe portions 16*a* and 16*b,* it is possible to facilitate the assembling of the noise level display device 40.

Further, since the noise level display device 40 is constituted by the noise level display plate 41 and the movable plate 42, it is possible to prominently label the noise level that is permissible or acceptable at quiet times or in quiet environments on the noise level display plate 41, and at the same time, to enable a user of the machine easily to recognize the appropriate noise level at the time of use. Therefore, a sufficient consideration for the prevention of excessive noise can be easily taken by properly adjusting the rotational speed of the internal combustion engine 11 so as to meet the permissible or desirable noise level.

In the foregoing explanation, the invention has been explained with reference to one embodiment. However, the invention should not be construed to be limited by the embodiment, but may be variously modified within the spirit of the present invention as claimed in the appended claims.

For example, although the present invention has been explained with reference to the case where a scale 41*b* indicating the noise level is placed on the noise level display plate 41, the contents of the scale 41*b* may be changed so as to make it possible to use the scale 41*b* as an engine speedometer. Further, the scale 41*b* may be replaced by a mark directly indicating the place of use or the time period of use. Furthermore, the scale 41*b* may be replaced by a mark having various colors, each indicating a level of noise.

Further, the protuberance 46 of the movable plate 42 need not be semi-cylindrical, but may be of any other shape as long as it does not cause a disturbance in the pressurized jet air flow P. For example, the protuberance 46 of the movable plate 42 may be flat plate-like.

As would be clearly understood from the aforementioned explanations, since a noise level proportional to the magnitude of force of the ejected air flow can be indicated by the noise level display device mounted on the air-ejecting pipe as a jet air flow which is pressurized and delivered by the blower fan is passed into the air-ejecting pipe, it is possible for a user of the machine to easily recognize the noise level with his or her naked eyes.

What is claimed is:

1. A power working machine having an air-ejecting pipe for conduction of a flow of a compressed air which is pressurized and delivered by a blower fan, characterized in that the air-ejecting pipe is provided with a noise level display device.

2. The power working machine according to claim 1, in which the air-ejecting pipe is composed of a pair of half pipe portions meeting at a juncture, and further characterized in that the noise level display device is mounted at the juncture of the pair of half pipe portions.

3. The power working machine according to claim 1, and further characterized in that the noise level display device comprises a noise level display plate and a movable plate.

4. The power working machine according to claim 3, and further characterized in that each of the half pipe portions is provided with a retaining groove for slidably retaining the movable plate by sliding engagement of both side portions of the movable plate and with a mounting portion for mounting the noise level display plate.

5. The power working machine according to claim 4, and further characterized in that the movable plate is biased in a direction opposite to the direction of the ejected air flow.

6. The power working machine according to claim 3, and further characterized in that the noise level display plate is provided with a visible mark for indicating a noise level.

7. The power working machine according to claim 3, and further characterized in that the noise level display plate is provided with an opening, and the movable plate is provided with an indicator projection which adapted to be moved within the opening.

8. The power working machine according to claim 3, and further characterized in that the movable plate is provided with a protuberance which is positioned for impingement thereon of an ejected air flow which is pressurized and delivered by the blower fan.

9. The power working machine according to claim 8, and further characterized in that the protuberance is semi-circular in cross-sectional shape.

10. A power working machine having an air-ejecting pipe for conduction of a flow of a compressed air which is pressurized and delivered by a blower fan, characterized in that the air-ejecting pipe is provided with a noise level display device that includes a display plate and a movable plate, the movable plate having a protuberance which is positioned for impingement thereon of an ejected air flow which is pressurized and delivered by the blower fan and the movable plate being biased in a direction opposite to the direction of the ejected air flow.

11. The power working machine according to claim 10, and further characterized in that the protuberance is semi-circular in cross-sectional shape.

12. The power working machine according to claim 10, in which the air-ejecting pipe is composed of a pair of half pipe portions meeting at a juncture, and further characterized in that the noise level display device is mounted at the juncture of the pair of half pipe portions.

13. The power working machine according to claim 12, and further characterized in that each of the half pipe portions is provided with a retaining groove for slidably retaining the movable plate by sliding engagement of both side portions of the movable plate and with a mounting portion for mounting the noise level display plate.

14. The power working machine according to claim 10, and further characterized in that the noise level display plate is provided with a visible mark for indicating a noise level.

15. The power working machine according to claim 10, and further characterized in that the noise level display plate is provided with an opening, and the movable plate is provided with an indicator projection which adapted to be moved within the opening.

* * * * *